US006762732B2

(12) United States Patent
Kohler et al.

(10) Patent No.: US 6,762,732 B2
(45) Date of Patent: Jul. 13, 2004

(54) METHODS FOR ASSEMBLING AND INSTALLING AN ANTENNA

(75) Inventors: Gerd Kohler, München (DE); Michael Schreiber, Aying-Göggenhofen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/357,701

(22) Filed: Feb. 3, 2003

(65) Prior Publication Data

US 2003/0112189 A1 Jun. 19, 2003

Related U.S. Application Data

(63) Continuation of application No. PCT/DE01/02736, filed on Jul. 19, 2001.

(30) Foreign Application Priority Data

Aug. 1, 2000 (DE) ..... 100 37 472

(51) Int. Cl.[7] ..... H01Q 1/36
(52) U.S. Cl. ..... 343/895; 343/702; 343/872
(58) Field of Search ..... 343/702, 718, 343/872, 895

(56) References Cited

U.S. PATENT DOCUMENTS 5,699,070 A * 12/1997 Mischenko et al. ..... 343/702
6,011,525 A * 1/2000 Piole ..... 343/895
6,016,130 A * 1/2000 Annamaa ..... 343/895
6,075,500 A * 6/2000 Kurz et al. ..... 343/895
6,163,301 A * 12/2000 Widfeldt ..... 343/702
6,340,954 B1 * 1/2002 Annamaa et al. ..... 343/895

FOREIGN PATENT DOCUMENTS

| | | |
|---|---|---|
| EP | 0 736 926 | 10/1996 |
| EP | 0 982 794 | 3/2000 |
| EP | 0 987 788 | 3/2000 |
| EP | 0 997 970 | 5/2000 |
| WO | WO 99/31756 | 6/1999 |

OTHER PUBLICATIONS

Patent Abstract of Japan—11298228—Oct. 27, 1999.

* cited by examiner

*Primary Examiner*—Wilson Lee
*Assistant Examiner*—Thuy Vinh Tran
(74) *Attorney, Agent, or Firm*—Bell Boyd & Lloyd LLC

(57) ABSTRACT

A method for assembling and installing an antenna, for mobile radios, which is formed by wire in a winding or twisting process and includes a helical part and a contact-making part, wherein the helical part being housed in a housing and secured in place via first snap-action hooks, the spring characteristics of the contact-making part allow advantageous contact-making capabilities during installation and fixing to a mobile radio housing, and the housing being secured within a mobile radio housing via second snap-action hooks.

12 Claims, 4 Drawing Sheets

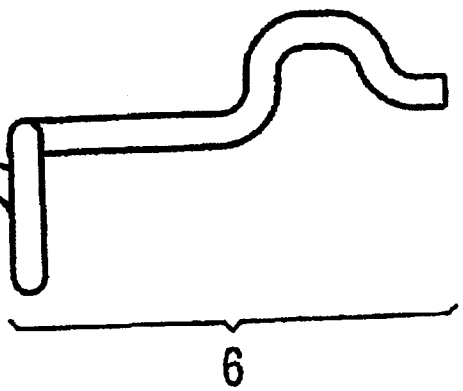
FIG 8A PRIOR ART
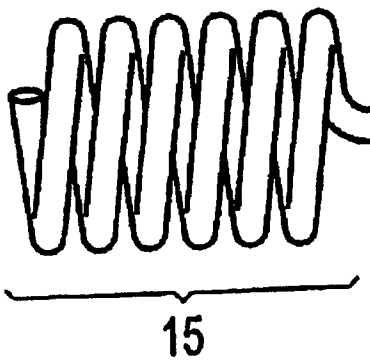
FIG 8B PRIOR ART
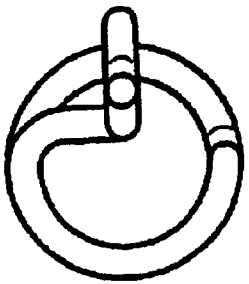

METHODS FOR ASSEMBLING AND INSTALLING AN ANTENNA

RELATED APPLICATIONS

This application is a continuing application of International Application PCT/DE01/02736 filed Jul. 19, 2001 and claims benefit under 35 U.S.C. §120.

BACKGROUND OF THE INVENTION

The present invention relates to methods for assembling and installing an antenna; in particular, for mobile radios.

Known mobile radio antennas are, by way of example, integrated antennas which are matched to the housing inner wall of a mobile radio and, thus, are not visually evident externally. These integrated antennas, which are relatively costly to produce, have the disadvantage that their transmission/reception efficiency is generally poorer than that of a helical antenna; in particular, when the volume of the integrated antenna is restricted. For a given rechargeable battery capacity, this results in a reduction in the period of operation between two charging processes, or requires a correspondingly greater rechargeable battery capacity for the same period of operation. In the same way, a connection to the base station can be terminated prematurely. Furthermore, it is possible for it not to be feasible to produce the integrated antennas in such integrated form if the bandwidth requirements are extreme.

Mobile radio antennas in the form of helical antennas are also known. These antennas are produced essentially from wire and include a transmitting and receiving part that is wound in a helical shape (the helical part), and a contact-making part which is coupled to a printed circuit board assembly in the mobile radio in order to transmit the transmission/reception power.

Although known helical antennas are costly to produce, since the shaping of a contact-making part can be achieved only by repeated three-dimensional bending of the wire, they are widely used.

Moreover, the automatic supply of the helical antennas, such as for assembly of a mobile radio telephone, is made more difficult by the fact that the antennas tend to become jammed when supplied as individual items so that they can be separated only with difficulty, if at all, in an automated manner.

A radio antenna which has a protective housing, is mechanically robust and makes contact with a printed circuit board is known from EP-A2 0 982 794. A multiband antenna is known from European Patent Application EP-A2 0 987 788, which contains a first conductor, which is wound in the form of a helix, and a second conductor, which is in the form of a short rod and which is in turn fitted to the free end of the helix.

WO 99/31756 A1 describes an antenna for transmitting and receiving radio frequency signals in the form of a cylindrical coil with different areas in which the separations differ.

In light of the above, the present invention is directed toward providing low-cost and simplified methods for assembling and installing an antenna.

SUMMARY OF THE INVENTION

First of all, a prior art helical antenna is illustrated, for example, in FIGS. 8A and 8B. This helical antenna includes a transmitting/receiving part and a contact-making part. The contact-making part differs considerably from a rotationally symmetrical part, which could assume any position when placed down on a flat surface. In fact, the orientation of a component according to the prior art is governed by the asymmetric shape of the contact-making part and results in the described difficulties in feeding such a component to an assembly process and in using a handling appliance to pick it up.

Conversely, the installation of a helical antenna is considered for the present invention, wherein the helical antenna is produced exclusively or predominantly by a winding and/or turning process. Winding processes such as these are used, for example, for producing tension springs.

An advantage of the pressure contact with the twisted contact-making part of the inventive helical antenna is that there is no need to orient the rotation position for assembly. Furthermore, any desired spring stiffness easily can be produced for the helical antenna by appropriate configuration of the wire diameter, the diameter of the turns and the number of turns which are arranged close to one another. A pressure contact is achieved easily and permanently, despite the shape and orientation tolerance of the partners between which contact is to be made.

A further advantage of the helical antenna of the present invention is that a wound-on terminating ring at the upper end of the helix results in advantageous transmission and reception characteristics.

One major feature of the contact-making part of the helical antenna as produced by the winding technique is that the turns also make direct electrical contact with one another when in the state when contact is made. This is achieved by the turns being produced such that they rest against one another in a prestressed manner. If this is not ensured, then the transmission and reception quality of the antenna may become poorer.

Yet a further advantage of the helical antenna form used is that the helical antenna can be moved directly into flexible plastic tubes via an automatic winding machine, which on the one hand can prevent damage, for example when transported as individual items, and on the other hand can offer the helical antennas in the correct orientation to an automatic assembly machine. As such, for example, there is no need for the conventional vibration helical feed systems for automatic assembly machines.

Additional features and advantages of the present invention are described in, and will be apparent from, the following Detailed Description of the Invention and Figures.

BRIEF DESCRIPTION OF THE FIGURES

FIGS. 8A and 8B illustrate helical antennas known in the prior art.

DETAILED DESCRIPTION OF THE INVENTION

Figure 2:
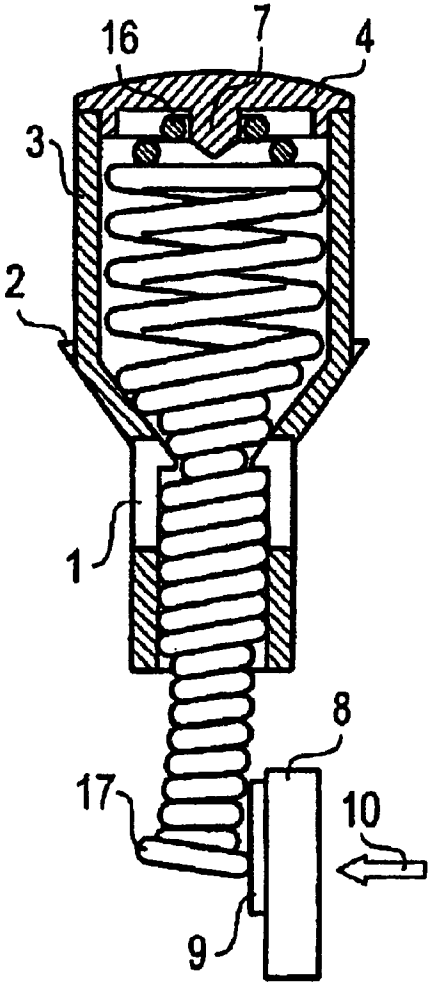
FIG. 2 shows the antenna from FIG. 1, with an upper portion of helical antenna shown in cross sectional form as well, and with a lower end of the helical antenna (or contact-making part) engaging a contact-making pad.
Figure 1:
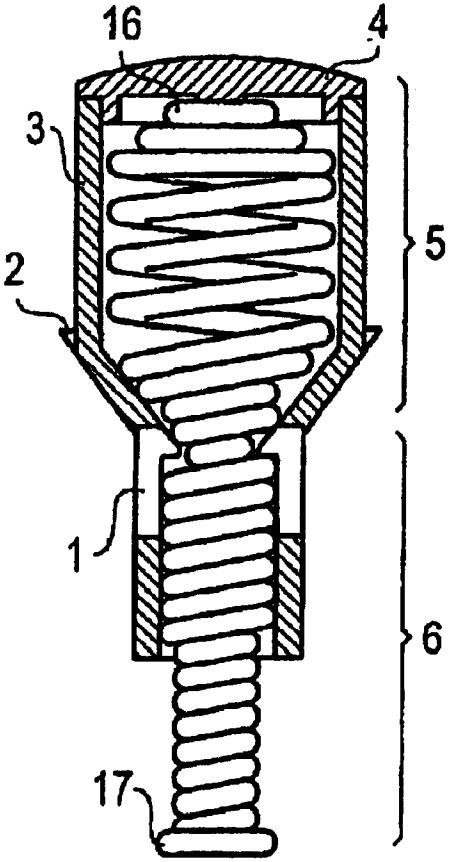
FIG. 1 shows a cross sectional view of the housing of the antenna of the present invention, exposing the helical antenna housed inside.

The general components of the antenna to which the present invention is directed may be observed with reference to FIGS. 1 and 2. The helical antenna is formed from a helical part 5 connected to a contact making part 6. The helical part 5 terminates on an upper end with an upper terminating ring 16, while the contact-making part 6 terminates on a lower end with a lower terminating ring 17. The helical antenna is housed within a housing 3 and secured in place via first snap-action hooks 1. A cover 4, which includes a centering pin 7 concentrically associated with the upper terminating ring 16, closes an opening of the housing 3 through which the helical antenna is inserted. Thereafter, second snap-action hooks 2 allow the housing to be secured within a mobile radio housing.

Assembly of the Antenna

Figure 7:
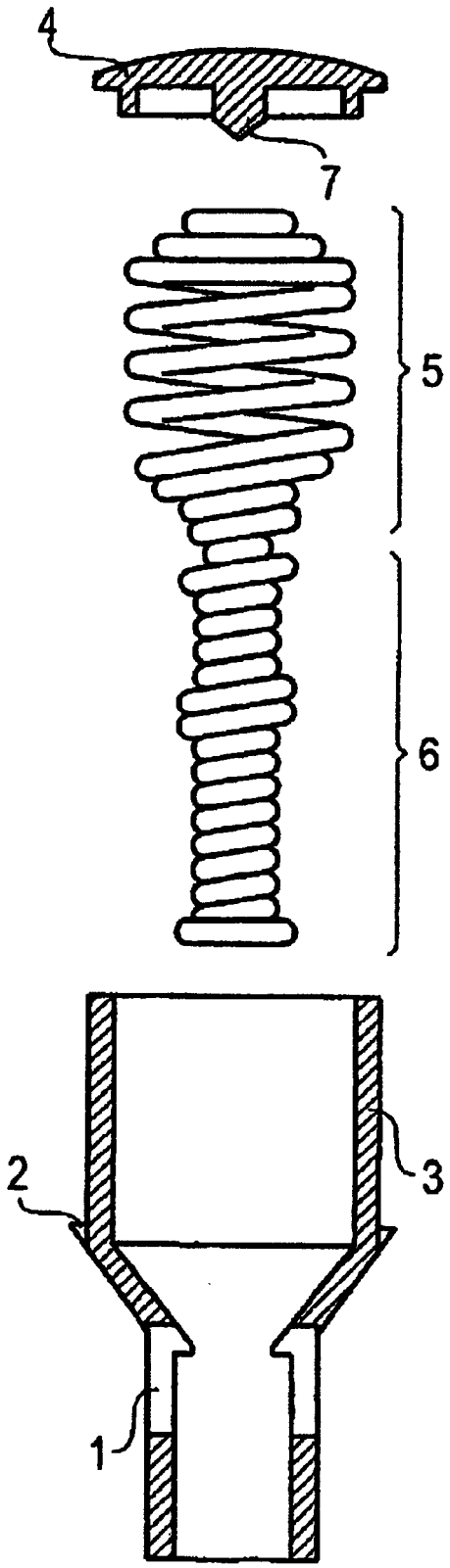
FIG. 7 shows an exploded view of the different components of the antenna of the present invention in an unassembled state.

With the housing 3 oriented in the correct position as in FIG. 7, (longitudinal axis vertical, a large housing opening at the top), the helical antenna (with the helical part 5 being joined to the contact-making part 6 in advance), is inserted into the opening in the housing 3. The contact-making part 6 is centered in a conical part of the housing 3 and is initially seated on first snap-action hooks 1.

By applying further pressure, such as by using a stepped cylindrical pin as a tool, the snap-action hooks 1 are pushed over the helical antenna until the helical antenna reaches its final position in the housing 3 (as shown in FIG. 1, for example). The stepped pin ensures that the insertion force does not act on the elastic helical part 5, but only on that part of the contact-making part 6 which is stiff in compression.

In a further embodiment, the snap-action hooks 1 are opened sufficiently wide before the joining of the helical antenna wherein the helical antenna reaches its final position, for example, by force of gravity. The snap-action hooks 1 are then released so as to fix the helical antenna in the housing 3.

The assembly of the antenna is completed by closing the housing 3 with the cover 4. In this case, the centering pin 7 in the center of the cover 4 limits the movement range of the helical part 5 without actually touching it. As such, in the event of a shock load, the oscillations of the helical part 5 are limited and decay quickly. The cover 4 itself is preferably connected to the housing 3 via a snap-action connection.

Installation and Pressure Contact of the Antenna

The preassembled antenna (helical antenna in the housing 3, cover 4 on the housing 3) is joined to the mobile radio telephone housing and latches in with second snap-action hooks 2.

Figure 4:
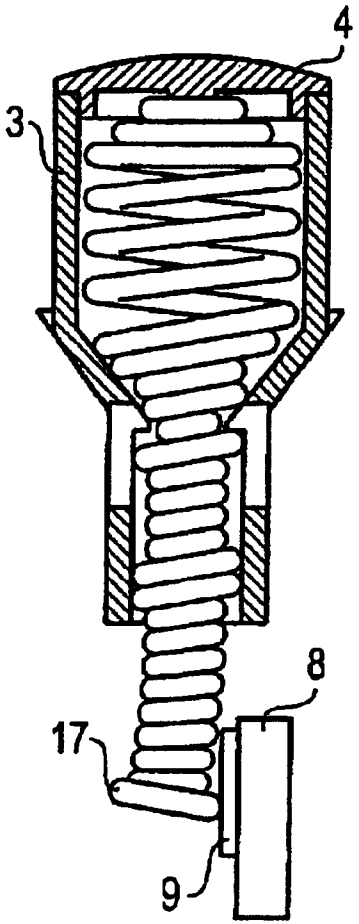
FIG. 4 shows the antenna from FIG. 3 with contact being made between the contact-making part and a contact-making pad.

After this, and as shown in FIGS. 2 and 4, a printed circuit board 8 is joined to the mobile radio telephone housing at right angles to the antenna longitudinal axis and is latched, for example, via snap-action hooks. In the process, a contact-making pad 9 moving in a joining direction 10 comes into contact with the lower end of the contact-making part 6, with the necessary contact-making pressure being produced by the contact-making part 6 bending to the side.

Figure 3:
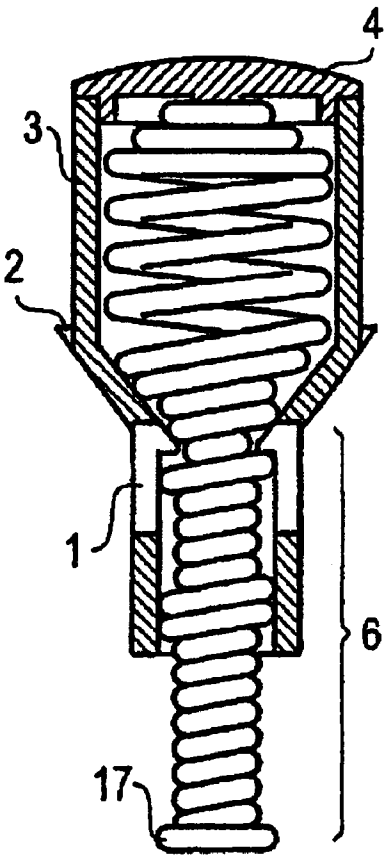
FIG. 3 shows an alternative embodiment of the antenna of the present invention wherein the contact-making part has a different spring configuration.

A different configuration of the contact-making part 6, as shown in FIGS. 3 and 4, advantageously allows a spring rate of the contact-making part 6 to be adjusted.

Figure 6:
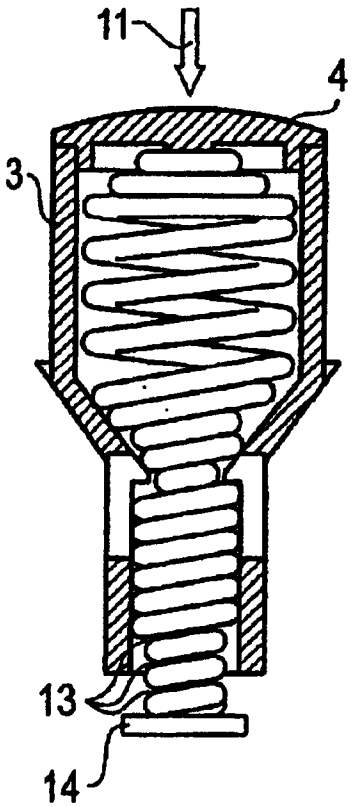
FIG. 6 shows the antenna from FIG. 5 wherein the contact-making part engages a contact-making pad in an axial direction.
Figure 5:
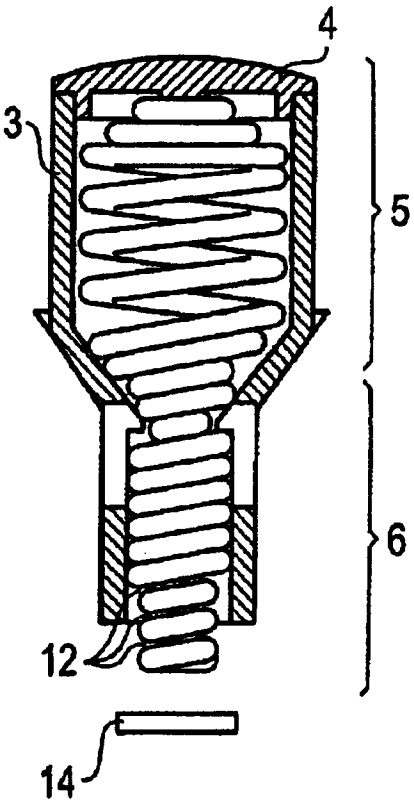
FIG. 5 shows an alternative embodiment of the antenna of the present invention, wherein the contact-making part has a different spring configuration.

A further principle for pressure contact is illustrated in FIGS. 5 and 6.

FIG. 5 shows the assembled antenna and a contact-making pad 14 from a printed circuit board. The necessary contact-making pressure is produced by the final lower turns of the contact-making part 6, which are in the form of a compression spring. These turns are separated by a first winding separation 12 when they are in the state when no contact is made.

Pushing and latching the antenna in a joining direction 11 into the mobile radio housing as shown in FIG. 6 results in the turns being pressed together to a smaller, second winding separation 13, thus producing the contact-making pressure.

Although the present invention has been described with reference to specific embodiments, those of skill in the art will recognize that changes may be made thereto without departing from the spirit and scope of the present invention as set forth in the hereafter appended claims.

What is claimed is:

1. A method for assembling an antenna for a mobile radio, the method comprising the steps of:

providing a cylindrically wound wire body having a helical part on a first end connected about a common axis to a contact-making part on a second end;

providing a housing of substantially internally rotationally symmetric design to the cylindrically wound wire body;

inserting the cylindrically wound wire body through an upper opening in the housing such that the contact-making part is centered in a conical part of the housing and abuts first snap-action hooks in the housing;

applying pressure on the cylindrically wound wire body such that the first snap-action hooks are pushed over the contact-making part and the cylindrically wound wire body assumes a final position in the housing with the first snap-action hooks locked; and closing the housing with a cover.

2. A method for assembling an antenna for a mobile radio as claimed in claim 1, the method further comprising a step of using a cylindrical pin when applying pressure on the cylindrically wound wire body for pushing the first snap-action hooks over the contact making part, the cylindrical pin acting directly on the contact-making part through the helical part.

3. A method for assembling an antenna for a mobile radio as claimed in claim 1, the method further comprising a step of providing a centering pin arranged centrally on the cover to limit a range of movement of the helical part, wherein the centering pin does not touch the helical part in a rest position.

4. A method for assembling an antenna for a mobile radio, the method comprising the steps of:

providing a cylindrically wound wire body having a helical part on a first end connected about a common axis to a contact-making part on a second end;

providing a housing of substantially internally rotationally symmetric design to the cylindrically wound wire body;

opening first snap-action hooks in the housing;

inserting the cylindrically wound wire body through an upper opening in the housing such that the contact-making part is centered in a conical part of the housing and assumes a final position in the housing;

closing the first snap-action hooks to fix the cylindrically wound wire body in the housing; and closing the housing with a cover.

5. A method for assembling an antenna for a mobile radio as claimed in claim 4, the method further comprising a step of providing a centering pin arranged centrally on the cover to limit a range of movement of the helical part, wherein the centering pin does not touch the helical part in a rest position.

6. A method for assembling an antenna for a mobile radio as claimed in claim 4, wherein, for the step of inserting the cylindrically wound wire body through the upper opening in the housing, the cylindrically wound wire body is allowed to assume the final position in the housing via force of gravity in a substantially vertical manner.

7. A method for installing an antenna for a mobile radio, the method comprising the steps of:

providing a cylindrically wound wire body having a helical part on a first end connected about a common axis to a contact-making part on a second end;

providing a housing of substantially internally rotationally symmetric design to the cylindrically wound wire body;

inserting the cylindrically wound wire body through an upper opening in the housing such that the contact-making part is centered in a conical part of the housing and abuts first snap-action hooks in the housing;

applying pressure on the cylindrically wound wire body such that the first snap-action hooks are pushed over the contact-making part and the cylindrically wound wire body assumes a final position in the housing with the first snap-action hooks locked;

closing the housing with a cover;

inserting the housing into a mobile radio housing; and latching the housing into the mobile radio housing via second snap-action hooks on the housing wherein, simultaneously, a contact-making pad on a printed circuit board of the mobile radio engages the contact-making part such that a spring force applied by the contact-making part produces a pressure contact therebetween.

8. A method for installing an antenna for a mobile radio as claimed in claim 7, the method further comprising a step of using a cylindrical pin when applying pressure on the cylindrically wound wire body for pushing the first snap-action hooks over the contact-making part, the cylindrical pin acting directly on the contact-making part through the helical part.

9. A method for installing an antenna for a mobile radio as claimed in claim 7, the method further comprising a step of providing a centering pin arranged centrally on the cover to limit a range of movement of the helical part, wherein the centering pin does not touch the helical part in a rest position.

10. A method for installing an antenna for a mobile radio, the method comprising the steps of:

providing a cylindrically wound wire body having a helical part on a first end connected about a common axis to a contact-making part on a second end;

providing a housing of substantially internally rotationally symmetric design to the cylindrically wound wire body;

opening first snap-action hooks in the housing;

inserting the cylindrically wound wire body through an upper opening in the housing such that the contact-making part is centered in a conical part of the housing and assumes a final position in the housing;

closing the first snap-action hooks to fix the cylindrically wound wire body in the housing;

closing the housing with a cover;

inserting the housing into a mobile radio housing; and latching the housing into the mobile radio housing via second snap-action hooks on the housing wherein, simultaneously, a contact-making pad on a printed circuit board of the mobile radio engages the contact-making part such that a spring force applied by the contact-making part produces a pressure contact therebetween.

11. A method for installing an antenna for a mobile radio as claimed in claim 10, the method further comprising a step of providing a centering pin arranged centrally on the cover to limit a range of movement of the helical part wherein the centering pin does not touch the helical part in a rest position.

12. A method for installing an antenna for a mobile radio as claimed in claim 10, wherein for the step of inserting the cylindrically wound wire body through the upper opening in the housing, the cylindrically wound wire body is allowed to assume the final position in the housing via force of gravity in a substantially vertical manner.

* * * * *